US010149353B2

(12) United States Patent
Houbloss et al.

(10) Patent No.: US 10,149,353 B2
(45) Date of Patent: Dec. 4, 2018

(54) MICROWAVE OVEN

(71) Applicant: Electrolux Appliances Aktiebolag, Stockholm (SE)

(72) Inventors: Omar Houbloss, Brest (FR); Arnd Hofmann, Rothenburg ob der Tauber (DE); Michael Wittmann, Rothenburg ob der Tauber (DE)

(73) Assignee: Electrolux Appliances Aktiebolag, Stockholm (SE)

( * ) Notice: Subject to any disclaimer, the term of this patent is extended or adjusted under 35 U.S.C. 154(b) by 147 days.

(21) Appl. No.: 14/915,077

(22) PCT Filed: Jul. 24, 2014

(86) PCT No.: PCT/EP2014/065953
§ 371 (c)(1),
(2) Date: Feb. 26, 2016

(87) PCT Pub. No.: WO2015/062754
PCT Pub. Date: May 7, 2015

(65) Prior Publication Data

US 2016/0212802 A1 Jul. 21, 2016

(30) Foreign Application Priority Data

Oct. 31, 2013 (EP) ..... 13191105

(51) Int. Cl.
*H05B 6/76* (2006.01)

(52) U.S. Cl.
CPC ..... *H05B 6/76* (2013.01)

(58) Field of Classification Search
CPC .. H05B 6/6402; H05B 6/6426; H05B 6/6485; H05B 6/702; H05B 6/705; H05B 6/72; H05B 6/74; H05B 6/745; H05B 6/76
USPC ..... 219/745, 736, 737, 738, 748, 749, 750, 219/751, 756, 757, 746
See application file for complete search history.

(56) References Cited

U.S. PATENT DOCUMENTS 4,053,730 A * 10/1977 Baron ..... H05B 6/745 219/738
4,327,266 A * 4/1982 Austin ..... H05B 6/74 219/749

(Continued)

FOREIGN PATENT DOCUMENTS

| | | | |
|---|---|---|---|
| DE | 4105300 | A1 | 8/1992 |
| EP | 2247160 | A1 | 11/2010 |
| WO | 2011080204 | A1 | 7/2011 |

OTHER PUBLICATIONS

International Search Report for PCT/EP2014/065953, dated Oct. 7, 2014, 2 pages.

*Primary Examiner* — Hung D Nguyen
(74) *Attorney, Agent, or Firm* — Pearne & Gordon LLP

(57) ABSTRACT

A microwave oven includes an oven muffle, a high-frequency oscillator for generating microwaves propagating within the oven muffle, an opening within the muffle wall of the oven muffle for passing a rotatable shaft of a motor through the muffle wall, and an element for suppressing microwave leakage through the opening. The element for suppressing microwave leakage is arranged at a distance to the muffle wall by a motor mounting element bearing the motor, such that there is no direct physical contact between the muffle wall and the suppression element.

13 Claims, 4 Drawing Sheets

(56) References Cited

U.S. PATENT DOCUMENTS 4,845,327 A 7/1989 Iwabuchi et al.
4,940,869 A * 7/1990 Scholtes ..... F24C 15/325
219/746

* cited by examiner

MICROWAVE OVEN

The present invention relates generally to the field of microwave ovens. More specifically, the present invention is related to leakage suppression for microwave ovens.

BACKGROUND OF THE INVENTION

Microwave ovens for preparing food are well known in prior art. Sophisticated models comprise a blower or fan in order to obtain air turbulences within the interior of the microwave oven.

Document DE 41 05 300 A1 discloses a blower for a microwave oven. The blower comprises a motor with a rotatable shaft extending through an opening of the oven muffle into the interior of the oven. At the free end of the rotatable shaft a blower wheel is attached. In order to reduce the microwave leakage through the opening, the opening matched to the rotatable shaft, the blower wheel, the dish connected with the oven muffle and a carrying plate of the motor form a microwave-proof blocking filter unit.

A drawback of the known microwave blocking filter unit is that due to the connection of the carrying plate with the oven muffle the suppression capability of the microwave blocking filter unit is decreased. Additionally, the microwave blocking filter unit comprises a complex structure and is therefore cost-intensive in manufacturing.

SUMMARY OF THE INVENTION

It is an objective of embodiments of the invention to provide technically simple and inexpensive means for suppressing microwave leakage of microwave ovens. The objective is solved by the features of the independent claim. Preferred embodiments are given in the dependent claims. If not explicitly indicated otherwise, embodiments of the invention can be freely combined with each other.

According to an aspect of the invention, the invention relates to a microwave oven comprising an oven muffle, a high-frequency oscillator for generating microwaves propagating within the oven muffle, an opening within a muffle wall of the oven muffle for passing a rotatable shaft of a motor through the muffle wall and means for suppressing microwave leakage through said opening, wherein the means for suppressing microwave leakage are arranged at a distance to the muffle wall by means of a motor mounting element bearing the motor and wherein there is no direct physical contact between the muffle wall and the suppression means.

Advantageously, the motor mounting element is adapted to bear the motor as well as the suppression means. Thereby a gap between the motor and the muffle wall used to reduce the heating of the motor (if the oven comprises further heating means, e.g. heating coils) may be additionally used to receive the suppression means. Due to avoiding a direct physical contact between the muffle wall and the suppression means, the suppression performance is significantly enhanced.

According to preferred embodiments, the motor mounting element comprises a bracket-like shape spanning at least a portion of the outer surface of the oven muffle. Thereby, the gap between the muffle wall and the suppression means for receiving the motor mounting element is achieved.

According to preferred embodiments, the motor mounting element comprises a middle portion to be disposed at a distance from the outer surface of the muffle wall and interconnecting portions for connecting the motor mounting element with the oven muffle.

Preferably, a pair of interconnecting portions spaced to each other is used to attach the motor mounting element at the oven muffle. Said interconnecting portions may protrude laterally from the middle portion at opposite sides. Thereby, the bracket-like shape of the motor mounting element is obtained.

According to preferred embodiments, the motor and the suppression means are located at different sides of the motor mounting element. Due to the opposite arrangement of the motor and the suppressing means, a single motor mounting element can be used to bear both elements. The motor and the suppressing means may be arranged such, that the rotatable shaft of the motor extends through an opening provided within the suppressing means.

According to preferred embodiments, the suppression means are constituted by a suppression element comprising a suppression portion to be located in vicinity to the opening and a retaining portion for keeping the suppression portion at a distance to the motor mounting element. The suppression portion is preferably arranged at a small distance e.g. 1-5 mm to the muffle wall. The suppression portion transforms the wave impedance in the area of the opening of the muffle wall. The retaining portion provides a portion for spacing the suppression portion at the desired distance from the muffle wall, respectively, from the motor mounting element.

According to preferred embodiments, the suppression portion comprises a disk-like shape. The suppression portion may be circular formed. Thereby, the radial distance between the opening of the muffle wall and the edge of the suppression portion is identical in all directions. The suppression portion may be constituted by a flat, sheet-like material or a corrugated material.

According to preferred embodiments, the retaining portion comprises a bushing-like shape. Thereby, the rotatable shaft of the motor may protrude through an opening of the bushing-like shaped retaining portion.

According to preferred embodiments, the suppression element comprises at least one fastening portion for attaching the suppression element at the motor mounting element. Thereby, the suppression element may be fastened at the motor mounting element independently of the fastening means of the motor, specifically at the opposite side of the motor.

According to preferred embodiments, the at least one fastening portion is located at the opposite side of the suppression portion. Thereby, the fastening portion and the suppression portion are spatially separated in order to increase the suppression leakage performance.

According to preferred embodiments, the suppression element is formed as a one-piece element.

According to preferred embodiments, the suppression means, particularly the suppression element are constituted or formed of an electrically conductive material.

The term "essentially" or "approximately" as used in the invention means deviations from the exact value by +/−10%, preferably by +/−5% and/or deviations in the form of changes that are insignificant for the function.

BRIEF DESCRIPTION OF THE DRAWINGS

The various aspects of the invention, including its particular features and advantages, will be readily understood from the following detailed description and the accompanying drawings, in which.

DETAILED DESCRIPTION OF PREFERRED EMBODIMENTS

Figure 1:
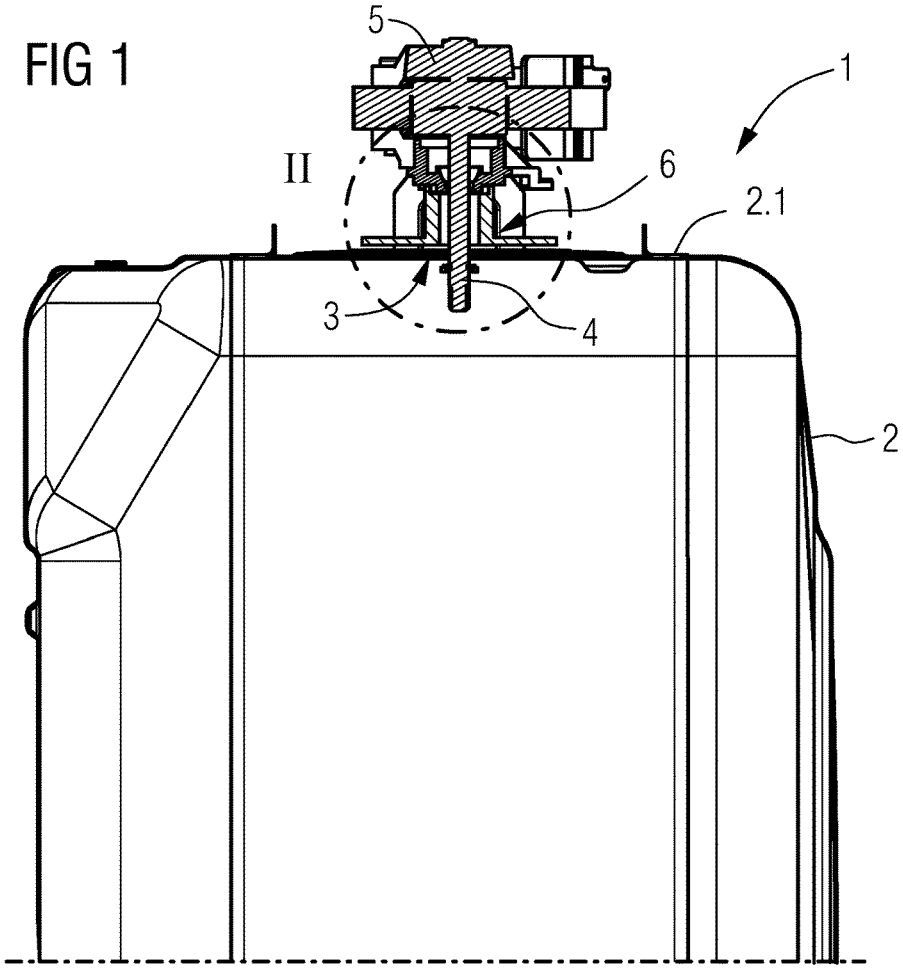
FIG. 1 shows an arrangement of motor and suppression element at an oven muffle.

The present invention will now be described more fully with reference to the accompanying drawings, in which example embodiments are shown. However, this invention should not be construed as limited to the embodiments set forth herein. Throughout the following description similar reference numerals have been used to denote similar elements, parts, items or features, when applicable.

FIG. 1 illustrates an oven muffle 2 of a microwave oven 1. The microwave oven 1 comprises a high frequency oscillator (not shown) which is adapted to generate microwaves within the oven muffle 2 in order to heat food arranged within the oven muffle 2. The microwave oven 1 further comprises a motor 5 with a rotatable shaft 4, wherein the motor 5 is attached at the oven muffle 2 such, that the rotatable shaft 4 extends through an opening 3 within a muffle wall 2.1 of the oven muffle 2 into the interior cavity of the microwave oven 1. According to the current embodiment, the rotatable shaft 4 of the motor 2 may be used to power a blower wheel. According to other embodiments, the rotatable shaft 4 may be used to power a turntable within the cavity of the microwave oven 1.

In order to avoid microwave leakage through the opening 3, the microwave oven 1 comprises a suppression element 6. Said suppression element 6 may be located in immediate vicinity of the opening 3. However, there is no direct physical contact between the muffle wall 2.1 of the oven muffle 2 and the suppression element 6. The suppression element 6 is kept in place by means of a motor mounting element (not shown in FIG. 1 and FIG. 2 and described in more detail in the following) which additionally supports the motor 5.

Figure 2:
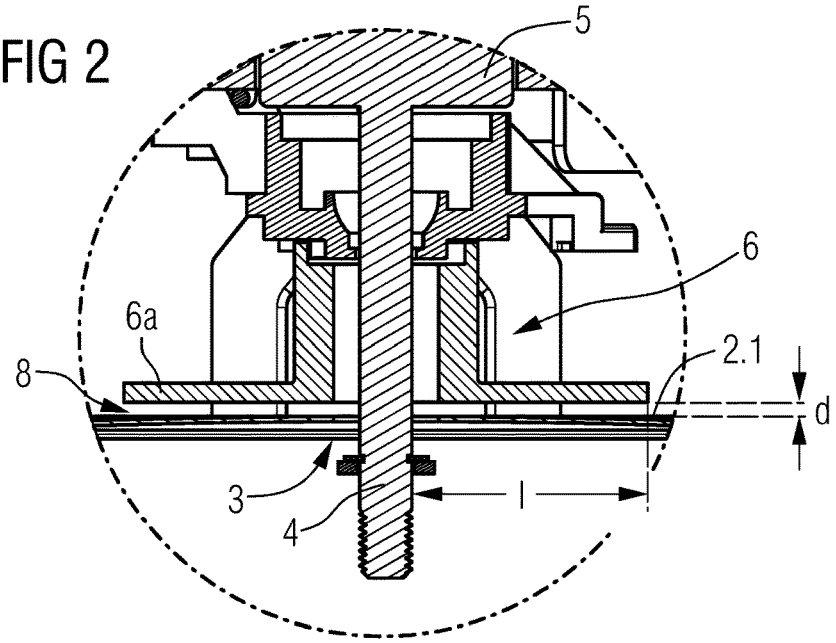
FIG. 2 shows the arrangement of FIG. 1 in a closer detail.

As shown in FIG. 2 in a higher level of detail, the suppression element 6 is preferably arranged at a distance d to the muffle wall 2.1, wherein the distance d is chosen according to the wavelength of the microwaves generated by the high frequency oscillator in order to provide a microwave-tight gap 8 between the suppression element 6 and the muffle wall 2.1.

Figure 3:
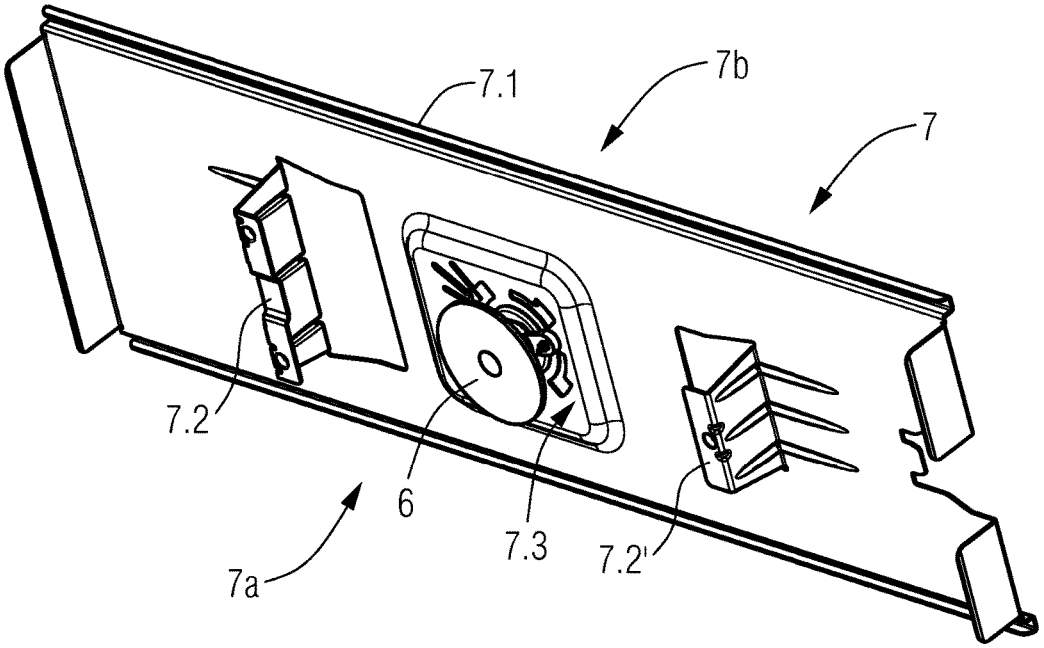
FIG. 3 shows the motor mounting element with the attached suppression element in a perspective view.
Figure 4:
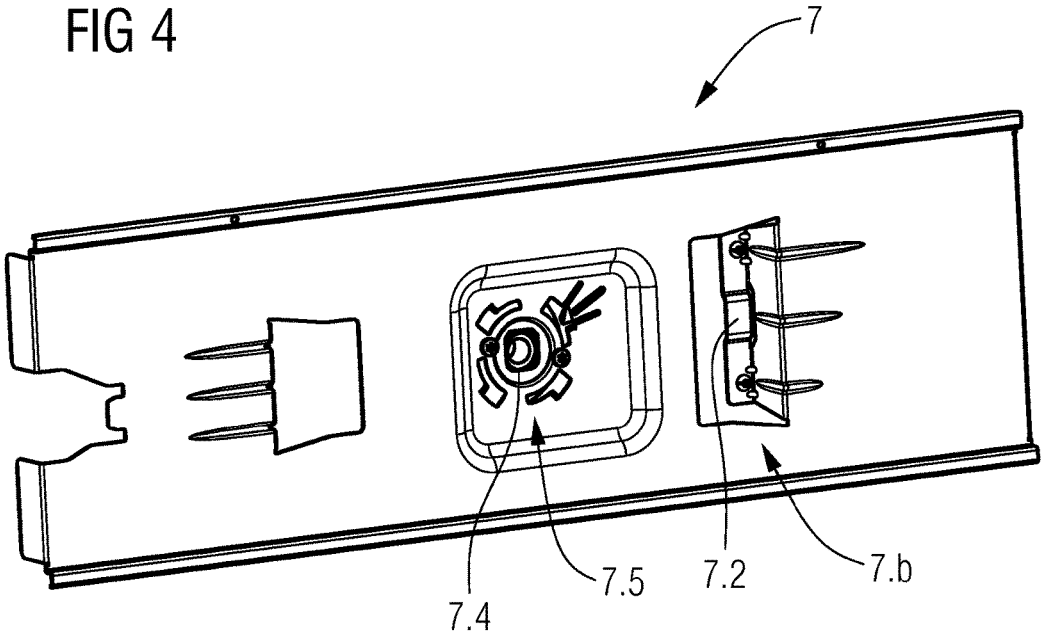
FIG. 4 shows the motor mounting element in a further perspective view.
Figure 5:
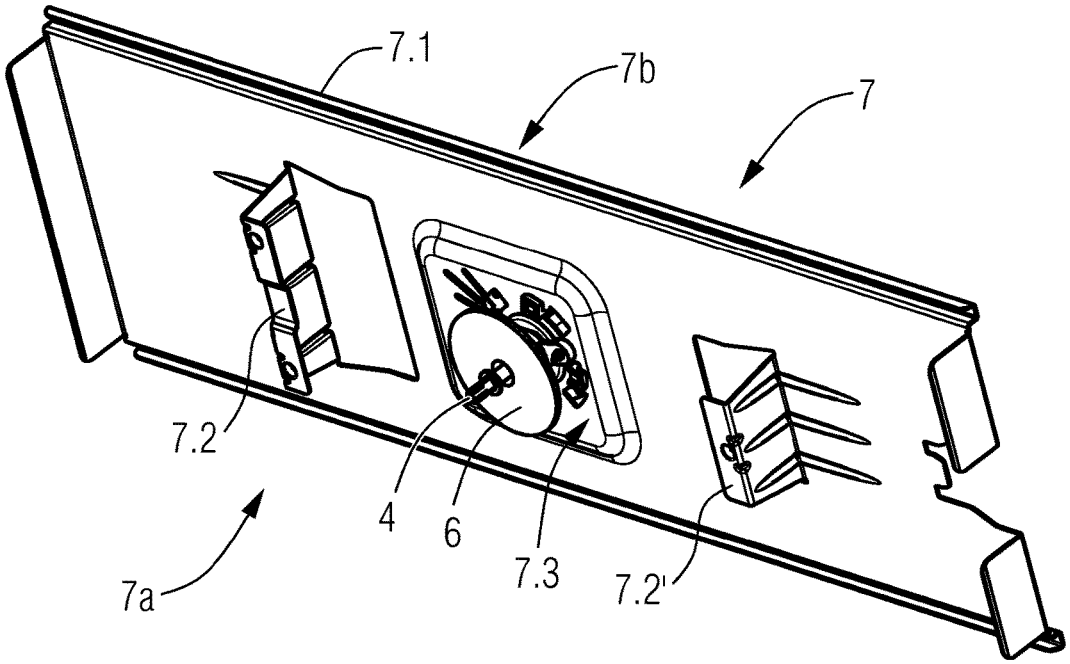
FIG. 5 shows the motor mounting element with the attached suppression element and the attached motor in a further perspective view.

FIG. 3-5 show the motor mounting element 7 in more detail. The motor mounting element 7 may be adapted to be attached to a side portion of the oven muffle 2 in order to arrange the motor at the oven muffle 2. The motor mounting element 7 comprises a front side 7*a* facing the muffle wall 2.1 when the motor mounting element 7 is attached to the oven muffle 2 and a back side 7*b* opposite to the muffle wall 2.1. Furthermore, the motor mounting element 7 comprises a middle portion 7.1 and interconnecting portions 7.2, 7.2' for attaching the motor mounting element 7 at the oven muffle 2. The middle portion 7.1 is adapted to receive the motor 5 at a motor mounting support 7.3 provided at the backside 7*b* of the motor mounting element 7. According to the current embodiment, the motor 5 is attached to the motor mounting element 7 by means of a bayonet connection. However, the connection between the motor 5 and the motor mounting element 7 may be realized by any other connection means, e.g. screws, clips etc. In the region of the motor mounting support 7.3, the motor mounting element 7 further comprises an opening 7.4 for passing through the rotatable shaft 4 of the motor 5.

At the front side 7*a* opposite to the motor mounting support 7.3, the motor mounting element 7 comprises a further mounting support 7.5 for attaching the suppression element 6 at the motor mounting element 7. Thereby, the motor mounting element 7 constitutes a mount for the motor 5 as well as the suppression element 6, wherein the motor 5 and the suppression element 6 are arranged at opposite sides of the motor mounting element 7. According to the current embodiment, the suppression element 6 is attached to the motor mounting element 7 by means of a pair of screws. However, the suppression element 6 may be attached to the motor mounting element 7 by any other fastening mechanisms known in prior art, e.g. bayonet connection, gluing etc.

When attaching the motor mounting element 7 at the outer side of the oven muffle 2, the motor 5 and the suppression element 6 are externally arranged at the muffle wall 2.1 such, that the rotatable shaft 4 of the motor 5 extends through the opening 3 and the free end of the rotatable shaft 4 is arranged within the interior of the oven muffle 2 in order to power a blower wheel. Thereby, the suppression element 6 is arranged at the outer side of the muffle wall 2.1 close to the opening 3 without direct physical contact to said muffle wall 2.1. It is worth mentioning that the motor mounting element 7 does not constitute a functional part regarding the suppression of microwave leakage. The sole function of the motor mounting element 7 is to provide means for keeping the motor 5 and the suppression element 6 in place. In a preferred embodiment, there is no electrically conductive connection between the motor mounting element 7 and the suppression element 6.

As illustrated in FIG. 3-FIG. 5, the motor mounting element 7 comprises a bracket-like shape. Thereby, the middle portion 7.1 is arranged at the distance to the muffle wall 2.1, at which the motor mounting element 7 is arranged. By means of the interconnecting portions 7.2, 7.2' extending laterally from the middle portion 7.1, a gap between said middle portion 7.1 and the muffle wall 2.1 is constituted, wherein within said gap the suppression element 6 is arranged. Preferably, the motor mounting element 7 is constituted by a piece of sheet material by punching and bending, most preferably by a one-piece element.

Figure 6:
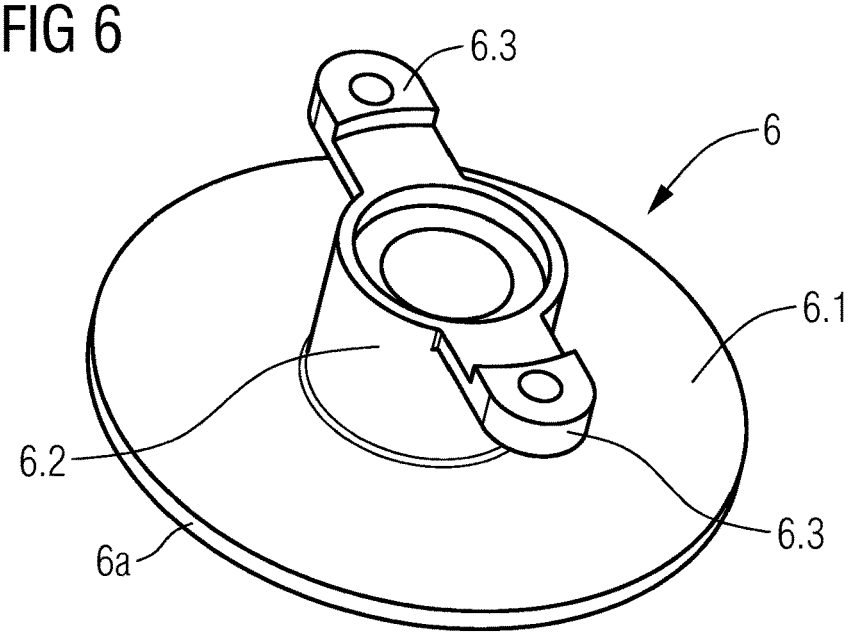
FIG. 6 shows the suppression element in a first perspective view.
Figure 7:
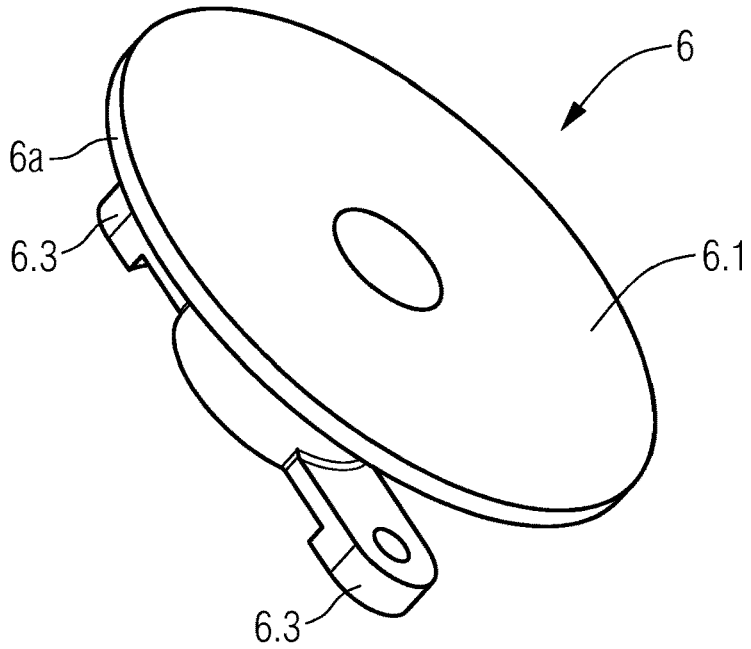
FIG. 7 shows the suppression element in a second perspective view.

FIG. 6 and FIG. 7 illustrate the suppression element 6 in a higher level of detail. The suppression element 6 comprises at least three segments, namely a suppression portion 6.1, a retaining portion 6.2 and at least one fastening portion 6.3. The suppression portion 6.1 which is to be arranged in close proximity to the muffle wall 2.1 in the area of the opening 3 comprises a disk-like shape. The suppression portion 6.1 is followed by the retaining portion 6.2 which provides a spacing of the suppression portion 6.1 from the motor mounting element 7. The suppression portion 6.1 and the retaining portion 6.2 comprise openings which are arranged in alignment to each other. Through said openings, the rotatable shaft 4 may be passed through. According to preferred embodiments, the retaining portion 6.2 comprises a bushing-like shape.

At the retaining portion, at least one fastening portion 6.3 is provided in order to attach the suppression element 6 at the motor mounting element 7. According to the current embodiment, the fastening portion 6.3 is constituted by a pair of straps protruding radially from the retaining portion 6.2 at opposite sides. Each strap comprises at least one opening for screwing the fastening portion 6.3 and thereby the whole suppression element 6 at the motor mounting element 7. Preferably, the suppression element 6 is constituted by a one-piece element made of an electrically conductive material.

LIST OF REFERENCE NUMERALS

1 microwave oven
2 oven muffle
2.1 muffle wall
3 opening
4 rotatable shaft
5 motor
6 suppression means/suppression element
6*a* edge
6.1 suppression portion
6.2 retaining portion
6.3 fastening portion
7 motor mounting element
7*a* front side
7*b* back side
7.1 middle portion
7.2, 7.2' interconnecting portions
7.3 motor mounting support
7.4 opening
7.5 mounting support
8 gap
d distance
l length

The invention claimed is:

1. A microwave oven comprising an oven muffle, a high-frequency oscillator for generating microwaves propagating within the oven muffle, an opening within a muffle wall of the oven muffle for passing a rotatable shaft of a motor through the muffle wall, and means for suppressing microwave leakage through said opening, wherein the means for suppressing microwave leakage are arranged at a distance to the muffle wall by means of a motor mounting element bearing the motor, wherein there is no direct physical contact between the muffle wall and the suppression means, wherein the motor mounting element comprises a middle portion configured to receive the motor and to be disposed at a distance from an outer surface of the muffle wall and a pair of interconnecting portions spaced apart from each other and extending laterally from the middle portion for connecting the motor mounting element with the oven muffle, wherein the pair of interconnecting portions create a gap between the middle portion of the motor mounting element and the muffle wall.

2. The microwave oven according to claim 1, wherein the motor mounting element comprises a bracket-like shape spanning at least a portion of the outer surface of the oven muffle.

3. The microwave oven according to claim 1, wherein the suppression means are located within the gap.

4. The microwave oven according to claim 1, wherein the motor and the suppression means are located at different sides of the motor mounting element.

5. The microwave oven according to claim 1, wherein the suppression means are constituted by a suppression element comprising a suppression portion to be located in vicinity to the opening and a retaining portion for keeping the suppression portion at a distance to the motor mounting element.

6. The microwave oven according to claim 5, wherein the suppression portion comprises a disk-like shape.

7. The microwave oven according to claim 5, wherein the retaining portion comprises a bushing-like shape.

8. The microwave oven according to claim 5, wherein the suppression element comprises at least one fastening portion for attaching the suppression element at the motor mounting element.

9. The microwave oven according to claim 8, wherein the at least one fastening portion is located at the opposite side of the suppression portion.

10. The microwave oven according to claim 5, wherein the suppression element comprises an opening for feeding the rotatable shaft through the suppression element.

11. The microwave oven according to claim 5, wherein the suppression element is formed as a one-piece element.

12. The microwave oven according to claim 1, wherein the suppression means are formed of an electrically conductive material.

13. The microwave according to claim 5, said suppression element being formed of an electrically conductive material.

* * * * *